US010639763B2

(12) United States Patent
Kopmanis

(10) Patent No.: US 10,639,763 B2
(45) Date of Patent: May 5, 2020

(54) METHOD FOR JOURNAL FINISHING OF CRANKSHAFTS, CAMSHAFTS, AND JOURNALS

(71) Applicant: Ford Motor Company, Dearborn, MI (US)

(72) Inventor: Michael A. Kopmanis, Monroe, MI (US)

(73) Assignee: Ford Motor Company, Dearborn, MI (US)

( * ) Notice: Subject to any disclaimer, the term of this patent is extended or adjusted under 35 U.S.C. 154(b) by 157 days.

(21) Appl. No.: 15/813,076

(22) Filed: Nov. 14, 2017

(65) Prior Publication Data

US 2019/0143472 A1 May 16, 2019

(51) Int. Cl.

| | |
|---|---|
| ***B24B 5/42*** | (2006.01) |
| ***B24D 9/08*** | (2006.01) |
| ***B24B 19/12*** | (2006.01) |
| ***B24D 7/06*** | (2006.01) |
| ***B24D 5/06*** | (2006.01) |
| ***B24B 35/00*** | (2006.01) |
| ***B24B 55/02*** | (2006.01) |

(52) U.S. Cl.

CPC ..... *B24B 5/42* (2013.01); *B24B 19/125* (2013.01); *B24B 35/00* (2013.01); *B24B 55/02* (2013.01); *B24D 5/06* (2013.01); *B24D 7/06* (2013.01); *B24D 9/08* (2013.01)

(58) Field of Classification Search

CPC ..... B24B 5/42; B24B 19/12
USPC ..... 451/49, 62, 57, 450, 53, 124, 127, 173
See application file for complete search history.

(56) References Cited

U.S. PATENT DOCUMENTS

| | | | | |
|---|---|---|---|---|
| 3,239,965 | A * | 3/1966 | Roney | B06B 3/00 451/124 |
| 3,273,288 | A * | 9/1966 | Kuris | B24B 1/04 451/178 |
| 4,024,672 | A * | 5/1977 | Wieck | B24B 19/06 451/163 |
| 4,907,374 | A | 3/1990 | Brill | |
| 5,063,714 | A | 11/1991 | Meyer | |
| 6,682,403 | B1 * | 1/2004 | Laycock | B24B 1/00 451/119 |
| 6,767,273 | B1 * | 7/2004 | Coverdale | B24B 1/00 451/5 |
| 6,878,043 | B1 | 4/2005 | Junker | |

(Continued)

FOREIGN PATENT DOCUMENTS

| | | |
|---|---|---|
| DE | 2627984 | 12/1977 |
| DE | 19511881 | 6/2009 |
| JP | 1086066 | 4/1998 |

OTHER PUBLICATIONS

Product page for Crankshaft Grinding, Petra Engineering, available at URL http://petraengineering.in/product.html.

(Continued)

*Primary Examiner* — Robert A Rose
(74) *Attorney, Agent, or Firm* — Burris Law, PLLC

(57) ABSTRACT

A method of grinding a surface of a crankshaft is provided. The method includes grinding the surface of the crankshaft by a grinding wheel, and polishing the surface of the crankshaft ground by the grinding wheel by oscillating a polishing wheel in a transverse direction perpendicular to a longitudinal direction of the crankshaft.

18 Claims, 9 Drawing Sheets

(56) References Cited

U.S. PATENT DOCUMENTS 8,172,644 B2 5/2012 Mizutani et al.

OTHER PUBLICATIONS

Bianchi, e.c. et al., The Grinding Wheel Performance in the Transverse Cylindrical Grinding of an Eutetic Alloy, Materials Research, vol. 5(4) pp. 433-438, 2002.

* cited by examiner

*P = Production Polish*
*T = Tapeless Polish*

*P = Production Polish*
*T = Tapeless Polish*

METHOD FOR JOURNAL FINISHING OF CRANKSHAFTS, CAMSHAFTS, AND JOURNALS

FIELD

The present disclosure relates to metal working processes, and more particularly to methods for grinding and finishing various surfaces of a crankshaft or a camshaft.

BACKGROUND

The statements in this section merely provide background information related to the present disclosure and may not constitute prior art.

Internal combustion engines generally require the use of a crankshaft to convert linear motion to rotational motion. Several surfaces of the crankshaft having various functions require machining to ensure proper operation of the crankshaft. Typically, some of the machining processes require spinning the crankshaft about a longitudinal axis that defines the main bearing journal axis of the crankshaft, while at the same time utilizing rotary grinding wheels to machine several various surfaces. This process is known as machine grinding.

During machine grinding, extreme heat and aggressive stock removal may alter micro structure and base metal hardness, creating slight dimensional and surface imperfections such as smeared peaks, waviness and chatter. A superfinishing process may be subsequently performed to improve surface finish and workpiece geometry by removing the amorphous layer formed during the grinding process.

A typical superfinishing process may be performed by using an abrasive tape or an abrasive stone. Abrasive tape finishing is more commonly used. Both tape finishing and stone finishing systems employ a series of mechanical clamping arms that must be positioned axially in line with the journals to be finished. With either system, the stone or the tape is clamped against the journals and remains stationary as the crankshaft rotates.

Performing the superfinishing process requires changing over from the grinding machine to the superfinishing system, positioning the various clamping arms of the superfinishing system, and positioning the tooling (stone or tape) relative to the journals of the crankshaft. Therefore, the typical method for grinding and finishing the crankshaft is complicated, time-consuming, and expensive.

This disclosure is directed to improving processes related to grinding and finishing journals and crankshafts.

SUMMARY

In one form, a method of grinding a surface of a crankshaft is provided, which includes grinding the surface of the crankshaft by a grinding wheel, and polishing the surface of the crankshaft ground by the grinding wheel by oscillating a polishing wheel in a transverse direction perpendicular to a longitudinal direction of the crankshaft.

In other features, the polishing wheel is oscillated at a stroke of 0.5 mm at a frequency of 8 Hz (mm/sec) and may be a vitrifiled or resin-bonded cubic boron nitride (CBN) wheel having a grain size of no greater than 46 microns (corresponding to 400 grit). It should be understood, however, that the oscillation stroke and frequency may be altered depending on the application while remaining within the scope of the present disclosure. In one form, the grinding wheel has a grain size of 151 microns (corresponding to 120 grit). The method further incudes applying a coolant during the polishing. The coolant may include 6% water without oil (water soluble), although other coolants such as oil-based coolants may be employed while remaining within the scope of the present disclosure. The polishing wheel may remove stock material from the crankshaft at a depth of between 10-50 microns, and in one form 20 microns. The grinding by the grinding wheel is plunge-grinding using a CBN wheel. The surface of the crankshaft may be a surface of a main bearing journal, a pin journal of the crankshaft, or a crank seal surface, among others that may require a fine finish.

In another form, a method of grinding and polishing a surface of a crankshaft is provided, which includes grinding the surface of the crankshaft by a grinding wheel, and polishing the surface of the crankshaft by a vitrifiled or resin-bonded CBN wheel having a grain size of no greater than 75 microns, and in one form no greater than 46 microns.

In still another form, a method of grinding and polishing main bearing journals and pin journals of a crankshaft is provided, which includes grinding the surface of the crankshaft by a grinding wheel, and oscillating a polishing wheel at a stroke between 0.05-1.0 mm, and in one form at a stroke of 0.5 mm in a transverse direction perpendicular to a longitudinal axis of the crankshaft to polish the surface ground by the grinding wheel. Generally, the oscillation reduces the surface finish further for a given grit size as this motion engages a different set of abrasive grains on the wheel. By oscillating too much, edges of the polishing wheel may break down and then form is lost. Additionally, on journals/parts which have a shoulder on either side, the amount of oscillation limits the width of the polishing wheel, which again affects breakdown of the wheel. In other features, the polishing wheel is oscillated at a frequency between 2-25 Hz, and in one form at 8 Hz and the polishing wheel has a grain size no greater than 46 microns.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The present disclosure will become more fully understood from the detailed description and the accompanying drawings, wherein.

Corresponding reference numerals indicate corresponding parts throughout the several views of the drawings.

DETAILED DESCRIPTION

The following description is merely exemplary in nature and is not intended to limit the present disclosure, application, or uses.

Figure 1:
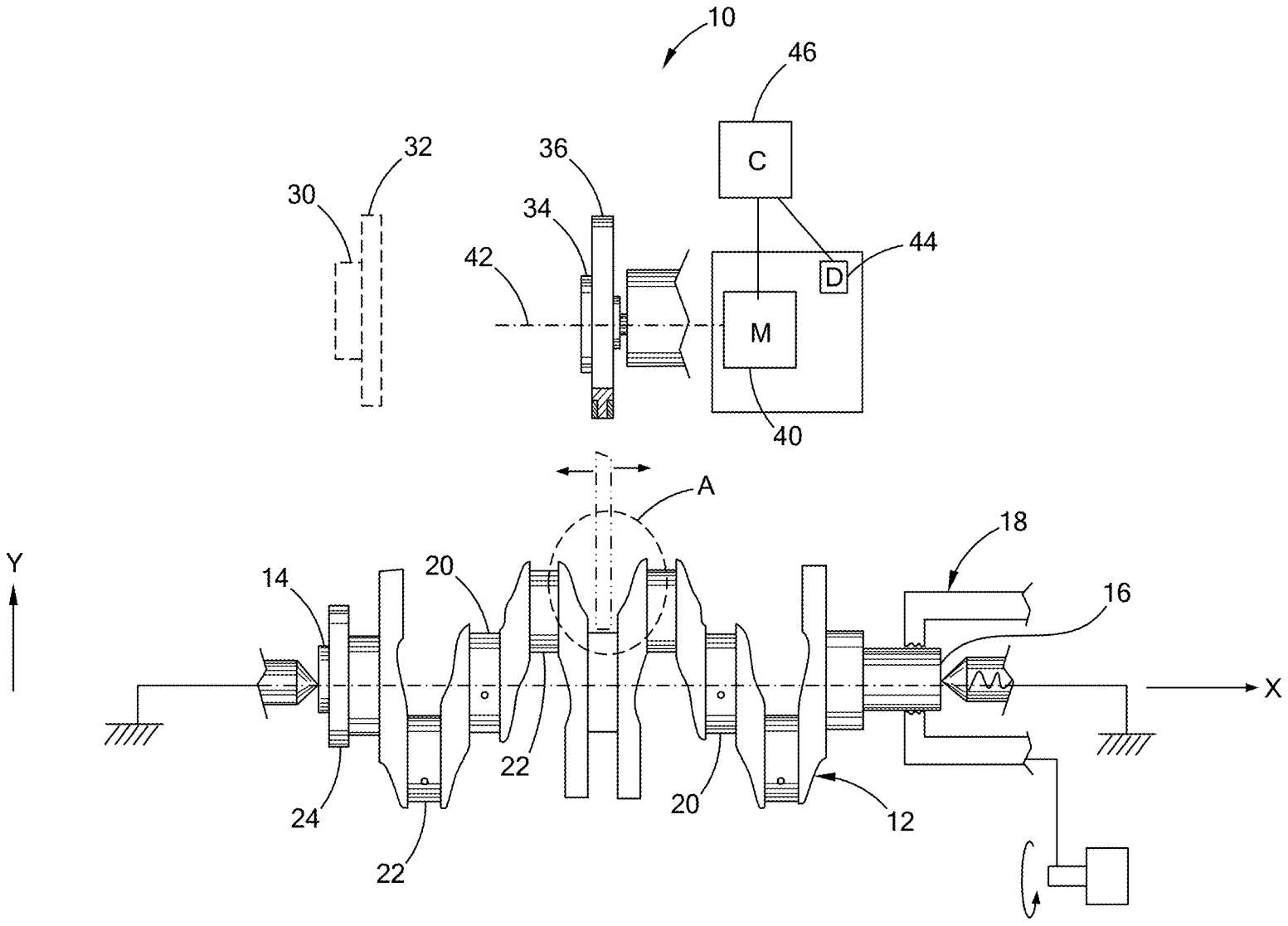
FIG. 1 is a schematic view of a crankshaft and a grinding machine that performs a method of grinding a surface of the crankshaft in accordance with the teachings of the present disclosure.

Referring to FIG. 1, a grinding machine 10 for grinding and polishing various surfaces of a crankshaft 12 is shown. The crankshaft 12 includes opposing ends 14 and 16 that define a longitudinal axis X of the crankshaft 12. The crankshaft 12 is rotatably supported at the opposing ends 14 and 16 by a clamping fixture 18 that secures and rotates the crankshaft 12 about the longitudinal axis X.

The crankshaft 12 generally includes a plurality of main bearing journals 18 aligned along the longitudinal axis X, a plurality of pin journals 22 and a flywheel 24. The pin journals 22 are disposed offset from the longitudinal axis X in a transverse direction Y perpendicular to the longitudinal direction X.

The grinding machine 10 includes a first spindle 30 supporting a grinding wheel 32 and a second spindle 34 supporting a polishing wheel 36. The grinding wheel 32 includes a peripheral surface for cutting and removing stock material from the main bearing journals 20 and the pin journals 22 of the crankshaft 12 to achieve a desired geometry. The polishing wheel 36 includes a peripheral surface for polishing and finishing the surface ground by the grinding wheel 32. The grinding wheel 32 may be made from a hard material, such as cubic boron nitride (CBN), aluminum oxide, or a hybrid combination, having a grain size between approximately 91-252 microns, and in one form approximately 151 microns (corresponding to 120 grit). The polishing wheel 36 may be made from a hard material, such as vitrified or resin-bonded CBN, aluminum oxide, or a hybrid combination having a grain size between approximately 15-76 microns, and in one form approximately 46 microns (corresponding to 400 grit).

The grinding machine 10 further includes a motor 40 that rotates the first and second spindles 30 and 34 about a central axis 42, and a drive 44 that drives the first and second spindles 30 and 34 to move in both the transverse direction Y that is radial with respect to the main bearing journals 20 of the crankshaft 12 and an axial direction B (shown in FIG. 2) parallel to the longitudinal axis X of the crankshaft 12. A controller 46 is configured to control the motor 40 and the drive 44 to rotate the the first and second spindles 30 and 34 around the central direction 42 and to move the first and second spindles 30 and 34 in the axial direction B and the transverse direction Y.

To grind a surface of the crankshaft 12, such as the surface of the main bearing journal 20 and the pin journal 22, the crankshaft 12 rotates around the longitudinal axis X and the first spindle 30 rotates about the central axis 42 and is moved toward the crankshaft 12 in the Y direction. When the peripheral surface of the grinding wheel 32 contacts the main bearing journal 20 and/or the pin journals 22, stock material is removed from the main bearing journals 20 and/or the pin journals 22 to achieve a desired geometry. The grinding process by the grinding wheel 32 may be a plunge-grinding. Using a grinding process to achieve a desired geometry is known in the art and thus the detailed description thereof is omitted herein for clarity.

After the grinding of the main bearing journals 20 and/or the pin journals 22 of the crankshaft 12 to achieve a desired geometry is completed, the first spindle 30 is moved away from the crankshaft 12. The second spindle 34 rotates around the central axis 42, is moved to be aligned with the main bearing journals 20 and/or the pin journals 22 and is moved toward the main bearing journals 20 and/or the pin journals 22 for a subsequent polishing process.

Figure 2:
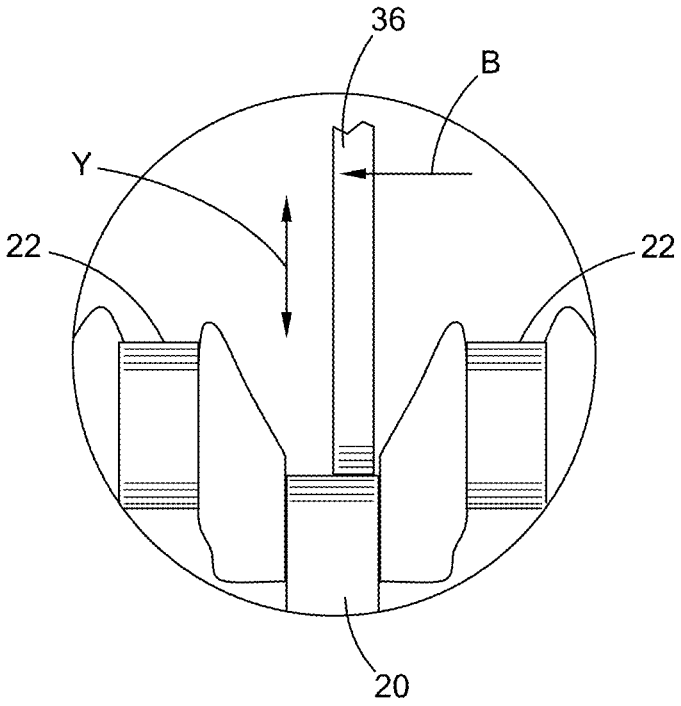
FIG. 2 is an enlarged view of portion A, showing movement of a polishing wheel relative to a main bearing journal of a crankshaft.

Referring to FIG. 2, during the polishing process, the polishing wheel 36 is oscillated in the transverse direction Y at a stroke of approximately 0.5 mm and at a frequency of approximately 8 Hz (mm/sec). The polishing process has a small degree of oscillation that is enough to engage a set of abrasive grain which reduces surface finish and enables comparatively larger grit sizes and increased wheel bond.

A coolant, which contains 6% water without oil, may be applied. The polishing wheel 36 may be a vitrified or resin-bonded CBN wheel having a grain size of 46 microns, corresponding to 400 grit. The polishing wheel 36 may remove stock material from the crankshaft at a depth of 20 microns.

The polishing process of the present disclosure without using an abrasive tape provides a polished surface that is superior to that by a typical tape finishing process. Further, the standard deviations are much more narrow for surface finish characteristics, thus resulting in a process that is more controlled and stable. In Table 1 below, various surface roughness measurements by the process of the present disclosure using a polishing wheel 36 and by a typical superfinishing process using an abrasive tape are compared.

TABLE 1

| | | Tapeless | | | | Standard Deviation % using Tape |
|---|---|---|---|---|---|---|
| Evaluation Metric | Definition | Min | Max | XBar | Standard Deviation | finishing P/U |
| Ra | Average roughness with | X | X | Δ | * | 50.22% |

TABLE 1-continued

| Evaluation Metric | Definition | Tapeless Min | Max | XBar | Standard Deviation | Standard Deviation % using Tape finishing P/U |
|---|---|---|---|---|---|---|
| | 0.8 cutoff | | | | | |
| Rt | Roughness profile | X | * | Δ | * | 60.34% |
| Rmax | Maximum roughness height within a sample length | X | Δ | Δ | * | 56.25% |
| Rz | Average maximum height | X | * | Δ | * | 46.64% |
| Rvk* | Highest value over entire trace. Estimate of depth of valleys below main plateau | Δ | * | Δ | Δ | 52.43% |
| Rpk* | Highest value over entire trace. Estimate of small peaks above main plateau | X | * | X | * | 79.93% |
| Rk | Slope of plateau | X | X | X | * | 71.59% |
| Rpk | Single highest value. S-area of peak above plateau. Lower = more uniform | X | * | X | * | 59.60% |
| Rvk | Single highest value. S-Area of valley below plateau. Lower = more uniform | X | * | Δ | * | 29.79% |
| Mr1 | Fraction of surface which consists of small peaks above plateau. Char. of peaks | X | Δ | X | * | 74.90% |
| Mr2 | Fraction of surface which will carry load | Δ | Δ | Δ | * | 72.90% |
| Rp | Maximum peak height | X | Δ | X | * | 80.64% |
| Rv | Maximum valley depth | A | * | Δ | * | 40.84% |
| Rq | Root mean square roughness or geometric average roughness | X | Δ | Δ | * | 43.02% |
| Pt | Unfiltered primary profile | Δ | * | Δ | * | 54.67% |
| Cv (Mr2) | Surface area not carrying load | Δ | * | Δ | * | 31.27% |
| Wt | Total waviness | Δ | * | Δ | Δ | 77.75% |
| Wa | Waviness average | Δ | * | * | * | 65.96% |
| Rmr-0.10 μm | Bearing ratio at ES Spec 0.1 μm slice | X | X | X | * | 45.22% |
| Rmr-0.20 μm | Bearing ratio at ES Spec 0.2 μm slice | X | X | X | * | 85.57% |
| Rmr-0.30 μm | Bearing ratio at ES Spec 0.3 μm slice | Δ | Δ | Δ | X | 162.22% |
| Rmr-0.40 μm | Bearing ratio at ES Spec 0.4 μm slice | Δ | Δ | Δ | X | 146.51% |
| R3z | Average $3^{rd}$ highest peak to $3^{rd}$ lowest valley | X | Δ | Δ | Δ | 53.19% |
| R3zm | Maximum $3^{rd}$ highest peak to $3^{rd}$ lowest valley | X | Δ | Δ | * | 26.54% |
| Rp3z | Highest peak over evaluation length to $3^{rd}$ lowest valley | X | X | X | * | 69.47% |

*: Superior to tape finishing, > 15%
Δ: same as tape finishing, within 15%
X: inferior to tape finishing, > 15%

As shown in Table 1, the tapeless process of the present disclosure generally has a standard deviation superior to that achieved by a typical tape finishing process. The minimum values of the polished surface by the tapeless process of the present disclosure is slightly higher than the typical tape finishing. This is because the polishing wheel 36 of the present disclosure has a larger grain size, i.e., 46 microns, compared to a grain size of 20 microns of an abrasive tape used in a typical superfinishing process. Therefore, surface roughness can be further reduced by reducing the polishing wheel grit size.

Figure 3:
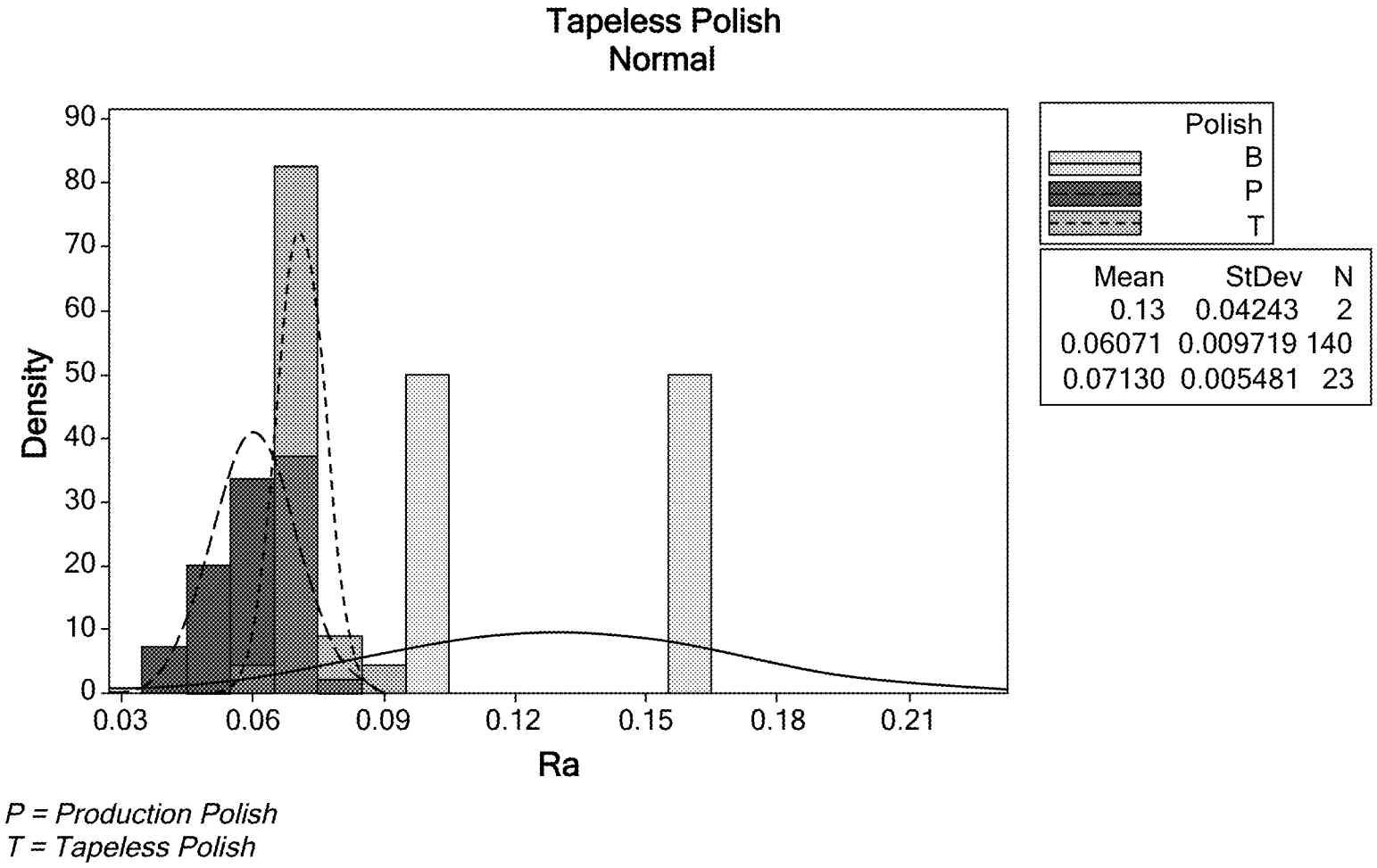
FIG. 3 depicts a bar diagram comparing an average roughness (Ra) of a polished surface of a crankshaft by a tapeless polishing process of the present disclosure, a typical tape polishing process, and a partial tape polishing process.

Referring to FIG. 3, a bar diagram comparing an average roughness (Ra) of the polished surfaces of the main bearing journals and the pin journals by the tapeless process (T) of the present disclosure, a typical tape polishing process (P), and a partial tape polishing process (B) is depicted. Ra is the average of a set of individual measurements of surface peaks and valleys.

Figure 4:
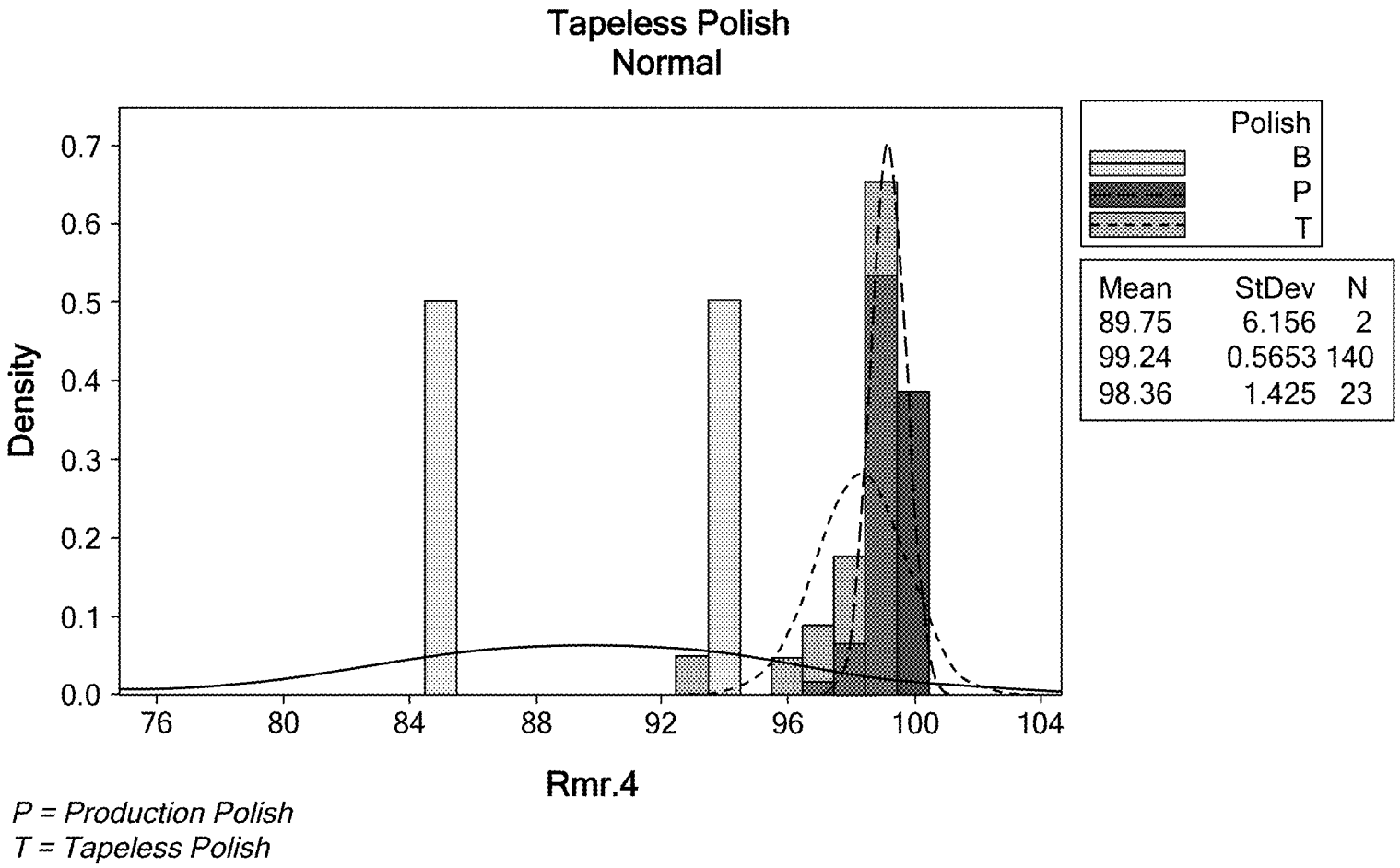
FIG. 4 depicts a bar diagram comparing a bearing ratio (Rmr) (0.4 um slice) of a polished surface of a crankshaft by a tapeless polishing process of the present disclosure, a typical tape polishing process, and a partial tape polishing process.

Referring to FIG. 4, a bar diagram comparing bearing ratio (Rmr) (0.4 μm slice) of the polished surfaces of the main bearing journals and the pin journals by the tapeless process (T) of the present disclosure, a typical tape polishing process (P), and a partial tape polishing process (B) is depicted. The typical tape polishing process uses a tape having a grain size of 20 microns, whereas the tapeless polishing process of the present disclosure uses a polishing wheel having a grain size of approximately 46 microns.

Figure 5:
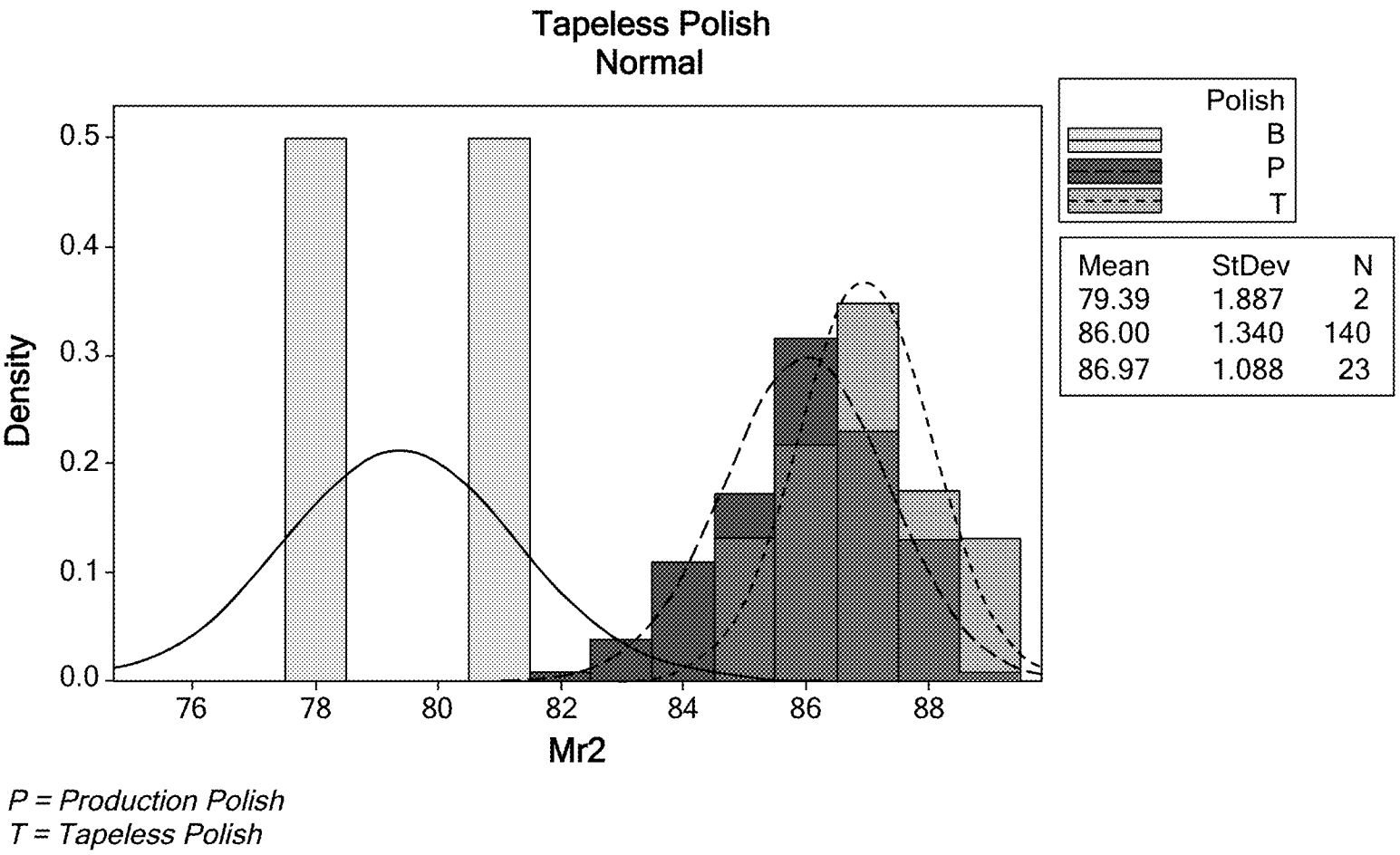
FIG. 5 depicts a bar diagram comparing fraction of a polished surface which will carry load (Mr2) by a tapeless polishing process of the present disclosure, a typical tape polishing process, and a partial tape polishing process.

Referring to FIG. 5, a bar diagram comparing fraction of the polished surface which will carry load (Mr2) by the tapeless process (T) of the present disclosure, a typical tape polishing process (P), and a partial tape polishing process (B) is depicted. As shown, the fraction of load carrying peak by the tapeless process (T) of the present disclosure using a polishing wheel is similar to that by the typical tape polishing process.

Figure 6:
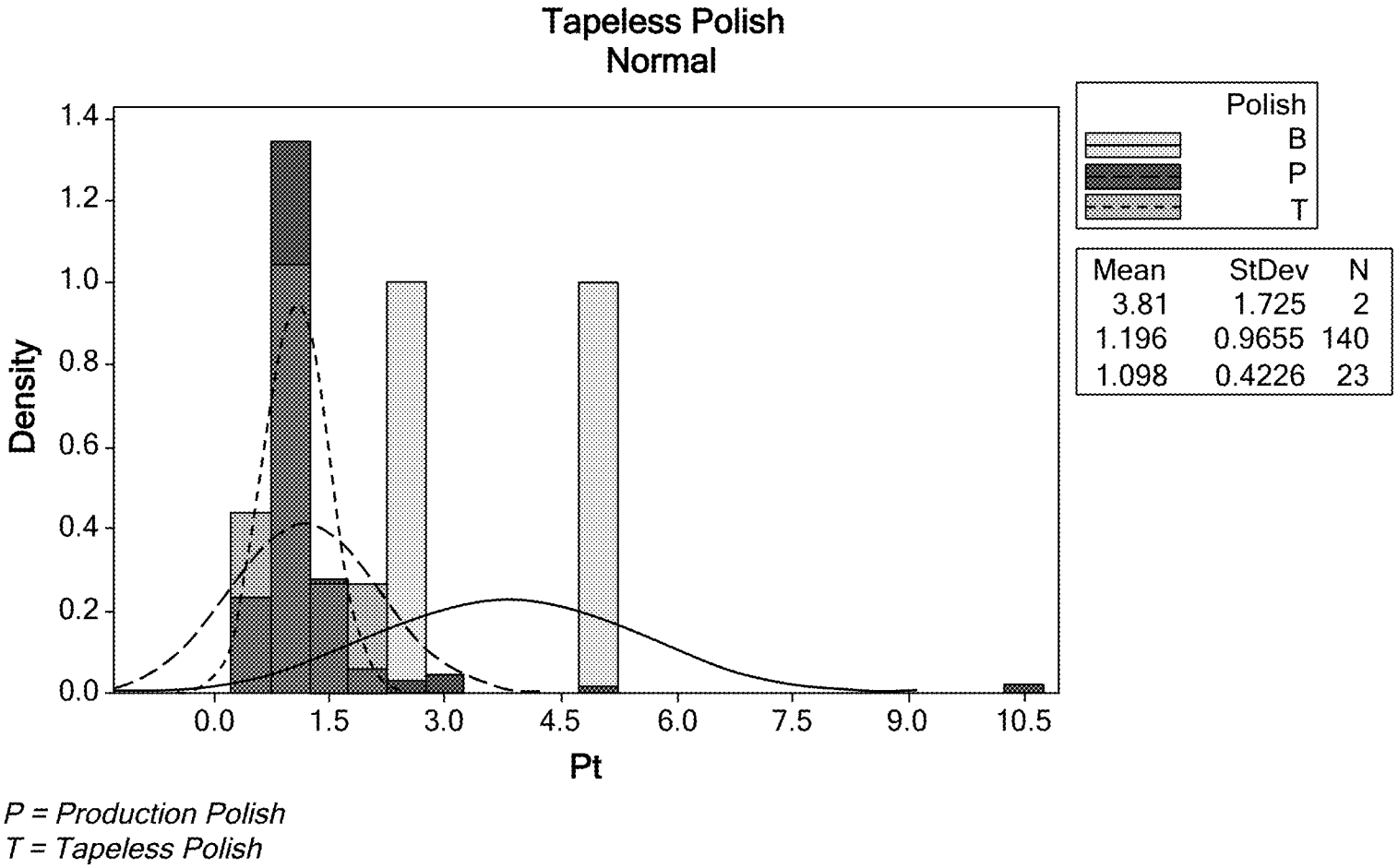
FIG. 6 depicts a bar diagram comparing unfiltered primary profile (Pt) of a polished surface of a crankshaft by a tapeless polishing process of the present disclosure, a typical tape polishing process, and a partial tape polishing process.

Referring to FIG. 6, a bar diagram comparing unfiltered primary profile (Pt) of the polished surfaces by the tapeless process (T) of the present disclosure, a typical tape polishing process (P), and a partial tape polishing process (B) is depicted. As shown, the tapeless process of the present disclosure achieves a more uniform unfiltered primary profile than the typical tape polishing process or a partial tape polishing process.

Figure 7:
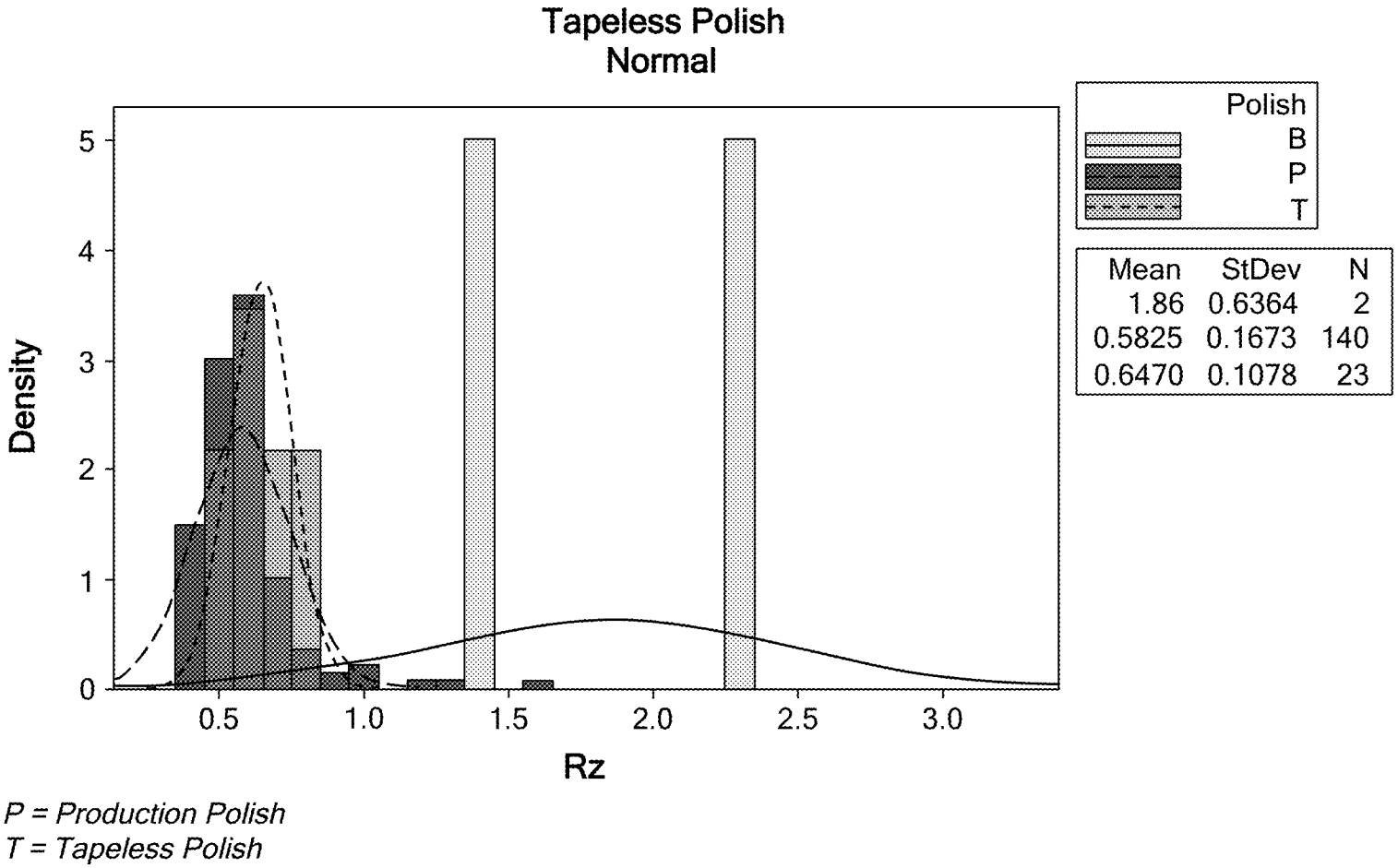
FIG. 7 depicts a bar diagram comparing average maximum height (Rz) of a polished surface of a crankshaft by a tapeless polishing process of the present disclosure, a typical tape polishing process, and a partial tape polishing process.

Referring to FIG. 7, a bar diagram comparing average maximum height (Rz) of the polished surfaces by the tapeless process (T) of the present disclosure, a typical tape polishing process (P), and a partial tape polishing process (B) is depicted.

Figure 8:
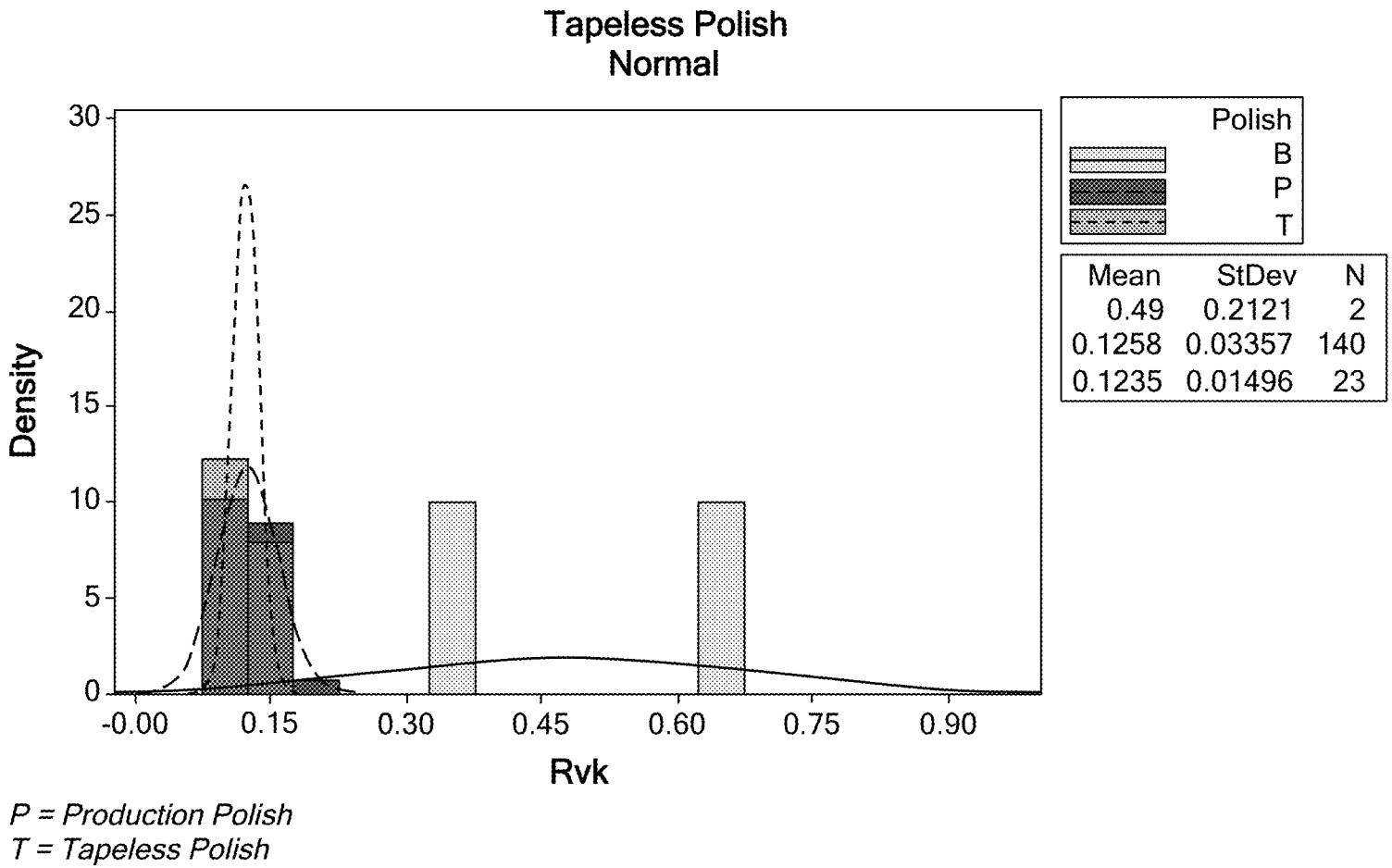
FIG. 8 depicts a bar diagram comparing single maximum valley below the plateau (Rvk) of a polished surface of a crankshaft by a tapeless polishing process of the present disclosure, a typical tape polishing process, and a partial tape polishing process.

Referring to FIG. 8, a bar diagram comparing single maximum valley below the plateau (Rvk) of the polished surfaces by the tapeless process (T) of the present disclosure, a typical tape polishing process (P), and a partial tape polishing process (B) is depicted. The tapeless polishing process of the present disclosure achieves a more uniform Rvk.

Figure 9:
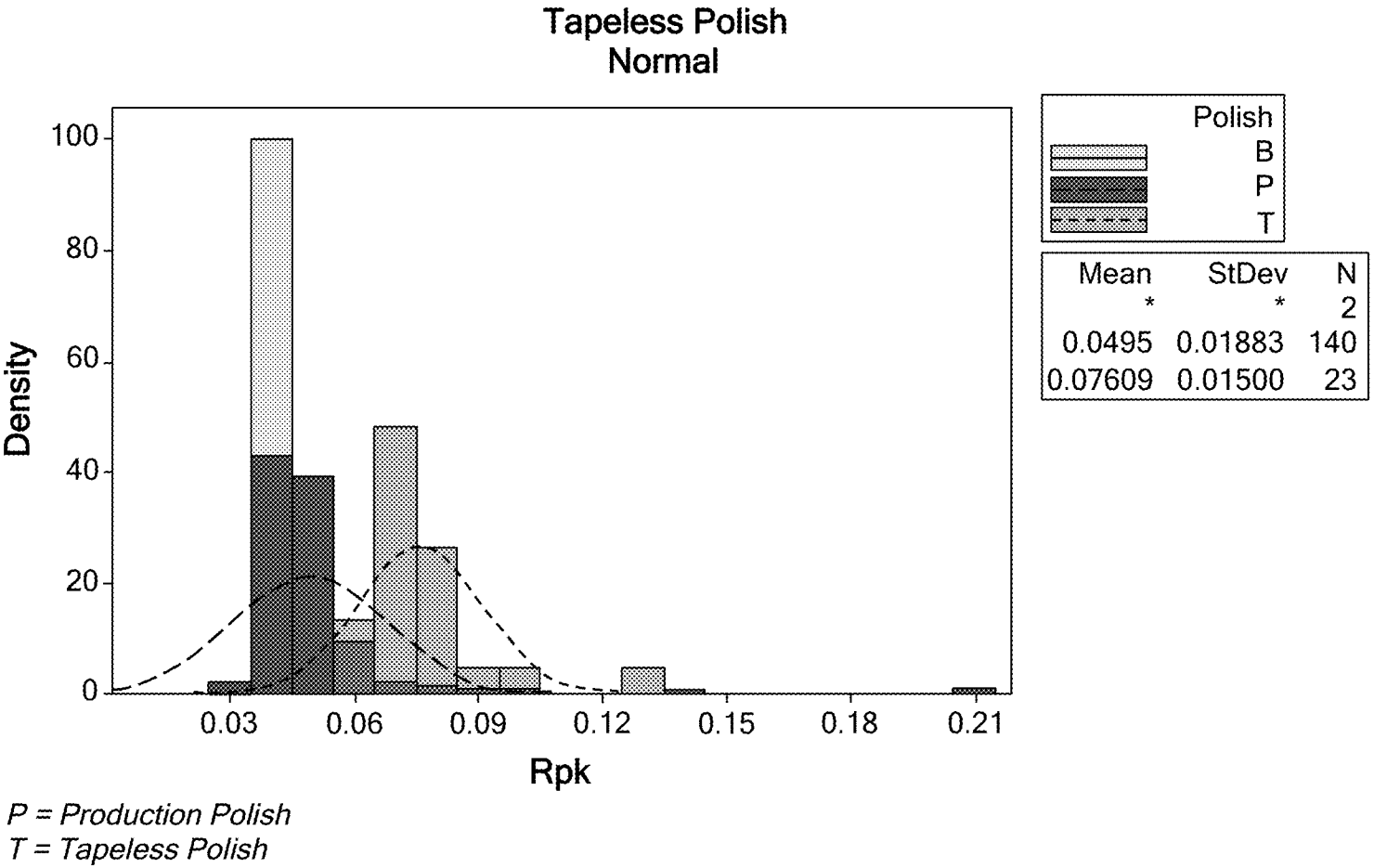
FIG. 9 depicts a bar diagram comparing single maximum peak above the plateau (Rpk) of a polished surface of a crankshaft by a tapeless polishing process of the present disclosure, a typical tape polishing process, and a partial tape polishing process.

Referring to FIG. 9, a bar diagram comparing single maximum peak above the plateau (Rpk) of the polished surfaces by the tapeless process (T) of the present disclosure, a typical tape polishing process (P), and a partial tape polishing process (B) is depicted. The tapeless process of the present disclosure achieves a slightly higher Rpk than a typical tape polishing.

The tapeless polishing process of the present disclosure uses a vitrified or resin-bonded CBN polishing wheel to achieve fine finishing surfaces on the main bearing journals and the pin journals of the crankshaft. No separate superfinishing system nor an abrasive tape is required, thereby simplifying tooling and saving equipment costs and changeover time.

Moreover, the polishing wheel can be self-dressed, thereby reducing perishable tool costs, as opposed to an abrasive tape that is consumable. Dressing the wheel refers to removing the current layer of abrasive, so that a fresh and sharp surface is exposed to the work surface. The process of the present disclosure reduces mechanical complexity, geometric form variation, overall cost, while increasing flexibility and quality.

Furthermore, the tapeless polishing process of the present disclosure provides improved geometric and size control and achieves more consistent surface finish. The tapeless method of the present disclosure can process parts which have been case hardened after preliminary journal finishing, offering an advantage as case depth levels can be reduced to improve productivity by 100% or more.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A method of grinding a surface of a workpiece, the method comprising:

grinding the surface of the workpiece by a grinding wheel; and polishing the surface of the workpiece ground by the grinding wheel by oscillating a polishing wheel at a frequency between 2-25 Hz in a transverse direction perpendicular to a longitudinal direction of the crankshaft.

2. The method according to claim 1, further comprising oscillating the polishing wheel at a stroke between 0.05-1.0 mm.

3. The method according to claim 1, further comprising applying a coolant during the polishing.

4. The method according to claim 3, wherein the coolant includes 6% water.

5. The method according to claim 1, wherein the polishing wheel is a cubic boron nitride (CBN) wheel.

6. The method according to claim 5, wherein the polishing wheel has a grain size between 15-76 microns.

7. The method according to claim 5, wherein the polishing wheel has 400 grit.

8. The method according to claim 5, wherein the polishing wheel is a vitrified CBN wheel.

9. The method according to claim 5, wherein the polishing wheel is a resin-bonded CBN wheel.

10. The method according to claim 1, wherein the polishing wheel removes stock material from the crankshaft at a depth of 20 microns.

11. The method according to claim 1, further comprising performing the grinding by plunge-grinding.

12. The method according to claim 11, wherein the plunge-grinding is performed by using a CBN wheel.

13. The method according to claim 11, wherein the CBN wheel for the plunge-grinding has a grain size of 151 microns.

14. The method according to claim 11, wherein the CBN wheel has 120 grit.

15. The method according to claim 1, wherein the surface is a surface of a main bearing journal or a pin journal of a crankshaft.

16. A method of grinding and polishing a surface of a crankshaft, the method comprising:

grinding the surface of the crankshaft by a grinding wheel; and polishing the surface of the crankshaft ground by the grinding wheel by oscillating a vitrified or resin-bonded cubic boron nitride (CBN) wheel having a grain size no greater than 46 microns at a frequency between 2-25 Hz in a transverse direction perpendicular to a longitudinal direction of the crankshaft.

17. A method of grinding and polishing main bearing journals and pin journals of a crankshaft, the method comprising:

grinding the surface of the crankshaft by a grinding wheel; and oscillating a polishing wheel at a stroke between 0.05-1.0 mm and a frequency between 2-25 Hz in a transverse direction perpendicular to a longitudinal axis of the crankshaft to polish the surface ground by the grinding wheel.

18. The method according to claim 17, wherein the polishing wheel has a grain size no greater than 46 microns.

* * * * *